US012606359B2

(12) United States Patent
Ong

(10) Patent No.: US 12,606,359 B2
(45) Date of Patent: Apr. 21, 2026

(54) COVER ASSEMBLY FOR SPRAY CAN AND SPRAY CAN

(71) Applicant: Samurai 2K Aerosol Sdn. Bhd., Johor Bahru (MY)

(72) Inventor: Yoke En Ong, Johor Bahru (MY)

(73) Assignee: Samurai 2K Aerosol Sdn. Bhd., Lima Kedai (MY)

( * ) Notice: Subject to any disclaimer, the term of this patent is extended or adjusted under 35 U.S.C. 154(b) by 162 days.

(21) Appl. No.: 18/712,241

(22) PCT Filed: Nov. 21, 2022

(86) PCT No.: PCT/MY2022/050117

§ 371 (c)(1),
(2) Date: May 21, 2024

(87) PCT Pub. No.: WO2023/090997

PCT Pub. Date: May 25, 2023

(65) Prior Publication Data

US 2024/0409300 A1 Dec. 12, 2024

(30) Foreign Application Priority Data

Nov. 22, 2021 (MY) ..... PI2021006943

(51) Int. Cl.
*B65D 83/20* (2025.01)
*B65B 3/10* (2006.01)
*B65B 31/00* (2006.01)

(52) U.S. Cl.
CPC ..... *B65D 83/20* (2013.01); *B65B 3/10* (2013.01); *B65B 31/003* (2013.01)

(58) Field of Classification Search
CPC ..... B65D 83/20; B65D 83/14; B65B 31/003; B65B 31/00; B65B 3/04; B65B 1/30; B65B 31/02; B65B 3/10
(Continued)

(56) References Cited

U.S. PATENT DOCUMENTS 7,523,768 B2 * 4/2009 Chassaing ..... B65B 31/003 141/369
11,485,524 B2 * 11/2022 Parviainen ..... B65B 31/00
(Continued)

FOREIGN PATENT DOCUMENTS

EP 0997396 5/2000
WO 2020088903 5/2020

OTHER PUBLICATIONS

Machine Translation of EP0997396 Jan. 31, 2023.
(Continued)

*Primary Examiner* — David J Walczak
(74) *Attorney, Agent, or Firm* — Preston Smirman; SMIRMAN IP LAW, PLLC

(57) ABSTRACT

A cover assembly for a spray can and the spray can comprising: an outer cover; a piston cover; and an insert tube, fixedly arranged on the top of the outer cover and communicating with an inner cavity of the outer cover. When the bottom end of the outer cover is buckled on the top of the can assembly of the spray can, the piston cover may fully enter the outer cover and shield a spray cap of the spray can; and when the top end of the outer cover is buckled on the top of the can assembly of the spray can, the inset tube may be inserted into the top so that the piston cover may sequentially push contents previously loaded into a place between the piston cover and the outer cover into the insert tube and the can assembly of the spray can after being pushed.

9 Claims, 8 Drawing Sheets

(58) Field of Classification Search
USPC ..... 222/386, 394; 141/3, 18, 20, 21, 25–27, 141/94, 113, 200, 369, 370; 53/79, 85
See application file for complete search history.

(56) References Cited

U.S. PATENT DOCUMENTS

| | | | | |
|---|---|---|---|---|
| 2006/0042717 | A1* | 3/2006 | Faure | B65B 57/005 141/20 |
| 2007/0062604 | A1 | 3/2007 | Chassaing | |
| 2009/0078333 | A1 | 3/2009 | Chassaing | |

OTHER PUBLICATIONS

International Search Report Dated Jan. 31, 2023, PCT/MY2022/050117.
Written Opinion of the International Searching Authority Dated, PCT/MY2022/050117.
International Preliminary Report On Patentability Dated Feb. 28, 2024, PCT/MY2022/050117.

* cited by examiner

COVER ASSEMBLY FOR SPRAY CAN AND SPRAY CAN

CROSS-REFERENCE TO RELATED APPLICATION

The instant application is a national phase of PCT International Application No. PCT/MY2022/050117 filed Nov. 21, 2022, and claims priority to Malaysian Patent Application Serial No. PI2021006943 filed Nov. 22, 2021, the entire specifications of both of which are expressly incorporated herein by reference.

FIELD OF THE INVENTION

The present disclosure belongs to the technical field of spraying, and particularly relates to a cover assembly for a spray can and the spray can including the cover assembly.

BACKGROUND OF THE INVENTION

Spray can is widely applied to various industries of medical treatment, industrial machinery, toys, crafts, buildings, advertising propaganda industry, logos, etc., which mainly includes a cover assembly capable of storing contents (e.g. drugs or paint), a spray cap arranged on the can assembly and capable of releasing the contents, and a cover buckled on the top of the can assembly of the spray can and shielding the spray cap. However, existing covers only have shielding and protecting effects and thus have a single-function defect, thereby being difficult to meet user's requirements.

SUMMARY OF THE INVENTION

In order to solve all or part of the above problems, the present disclosure aims to provide a cover assembly for a spray can and the spray can including the cover assembly. The cover assembly is more functional and helps to improve user's satisfaction when using the spray can.

According to a first aspect of the present disclosure, provided is a cover assembly for a spray can, which includes: an outer cover; a piston cover, capable of being mounted into the outer cover in a push-pull mode; and an insert tube, fixedly arranged on a top of the outer cover and communicating with an inner cavity of the outer cover. Wherein, when a bottom end of the outer cover is buckled on a top of a can assembly of the spray can, the piston cover may fully enter the outer cover and shield a spray cap of the spray can; and when a top end of the outer cover is buckled on the top of the can assembly of the spray can, the inset tube may be inserted into the top so that the piston cover may sequentially push contents previously loaded into a place between the piston cover and the outer cover into the insert tube and the can assembly of the spray can after being pushed.

Further, the outer cover includes: an outer cover circumferential wall, with a bottom being capable of sleeving an inwardly-curled structure or outwardly-curled structures of the can assembly of the spray can, wherein the inwardly-curled structure is a connecting structure between a transfer cover of the can assembly and a valve cover of the can assembly, and the outwardly-curled structures are connecting structures between the transfer cover and a can body of the can assembly; and an outer cover top wall, connected with a top wall edge of the outer cover circumferential wall and provided with a central through hole, the insert tube being arranged on the top of the outer cover in an inserting mode and communicating with the inner cavity of the outer cover through the central through hole.

Further, the cover assembly further includes a first ring wall, a second ring wall and/or a third ring wall, the first ring wall being coaxially arranged on a top of the outer cover circumferential wall and capable of being jointed with a peripheral face of a central convex part of the valve cover in a matched mode, the second ring wall being coaxially arranged on the top of the outer cover circumferential wall and capable of being jointed with an inner edge of the inwardly-curled structure of the can assembly in a matched mode, and the third ring wall being coaxially arranged on the top of the outer cover circumferential wall and capable of being jointed with an outer edge of the inwardly-curled structure of the can assembly in a matched mode.

Further, a joint mode between the first ring wall and the central convex part of the valve cover is threaded connection or clamping joint.

Further, the piston cover includes a piston cover circumferential wall, a piston cover top wall connected with a top edge of the piston cover circumferential wall, and a bent wall fixedly sleeving a top of the piston cover circumferential wall and bent towards a bottom of the piston cover circumferential wall, the bent wall being capable of being jointed with an inner surface of the outer cover circumferential wall of the outer cover in a sealed mode, and the bent wall having greater elasticity than the piston cover circumferential wall.

Further, the bent wall includes a radial part outwardly extending from the top edge of the piston cover circumferential wall in a radial direction, a circumferential part extending from an outer edge of the radial part in an axial direction, and a cocked eave arranged on the circumferential part in a surrounding mode and capable of being jointed with the inner surface of the outer cover circumferential wall in a sealed mode.

Further, the piston cover and the outer cover are both made of resin materials.

Further, the cover assembly further includes a gland, the gland being capable of being buckled on the top end of the outer cover and blocking the insert tube, and also being capable of being buckled on the bottom end of the outer cover and blocking a bottom end of the piston cover 2.

Further, a joint mode between the gland and the piston cover is threaded connection or clamping joint, and connection between the gland and the outer cover is also threaded connection or clamping joint.

According to a second aspect of the present disclosure, provided is a spray can, which includes a can assembly, a spry cap and the cover assembly according to the first aspect of the present disclosure.

In the cover assembly for the spray can and the spray can including the cover assembly, which are involved in the present disclosure, the cover assembly may push the contents into the can assembly of the spray can in addition to shielding the spray cap of the spray can, and thus a user may load the temporarily-selected or temporarily-deployed contents into the can assembly of the spray can according to requirements and realize paint spraying or drug spraying or the like through the spray can, which ensures that the cover assembly is more functional and helps to improve user's satisfaction when using the spray can. In addition, the cover assembly is simple in structure, easy to assemble, safe and reliable in use and convenient to implement, popularize and apply.

BRIEF DESCRIPTION OF THE DRAWINGS

Preferred embodiments of the present disclosure will be described in detail below in conjunction with the drawings. In figures.

In the drawings, identical parts use identical drawing indications. The drawings are not drawn to actual proportions.

DETAILED DESCRIPTION OF THE EMBODIMENTS

The present disclosure will be further illustrated below in conjunction with the drawings.

Figure 1:
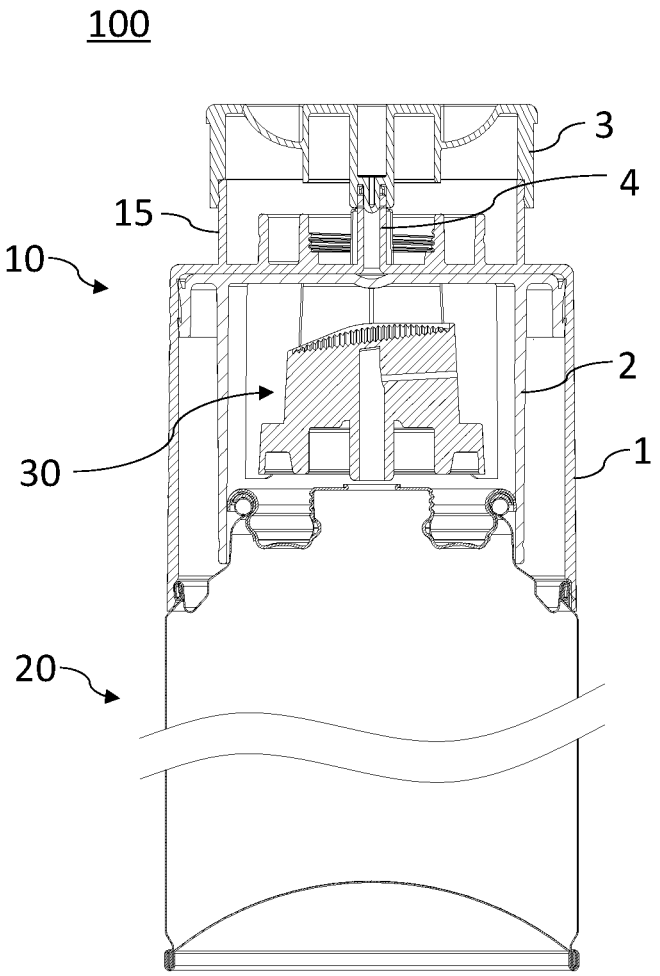
FIG. 1 shows a usage state diagram 1 of a spray can of an embodiment of the present disclosure.
Figure 2:
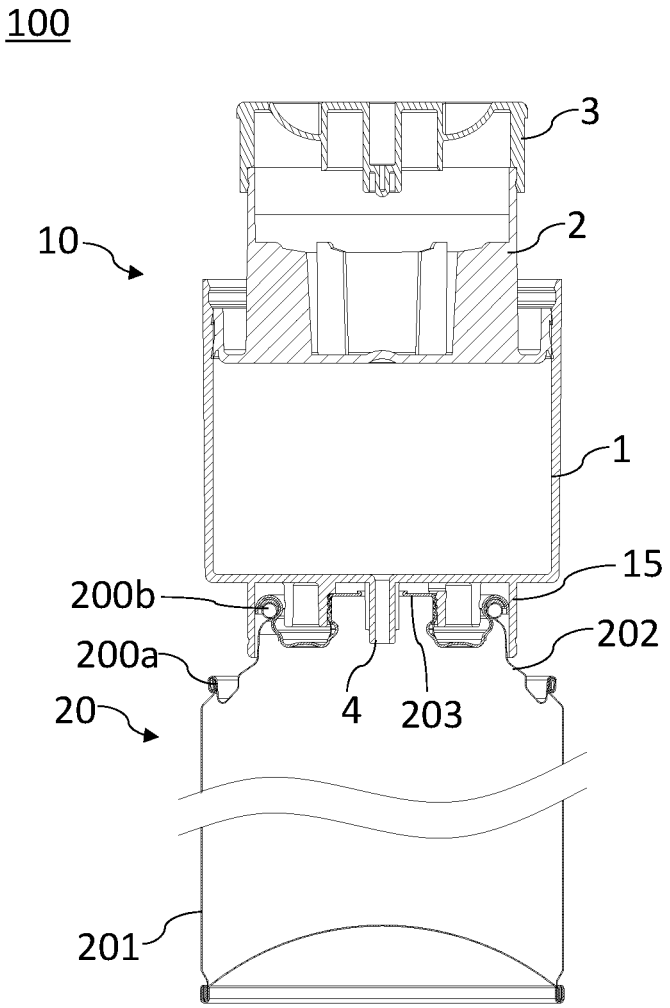
FIG. 2 shows a usage state diagram 2 of the spray can of the embodiment of the present disclosure.

Both FIG. 1 and FIG. 2 show a spray can of an embodiment of the present disclosure, as shown in FIG. 1 and FIG. 2, the spray can 100 mainly includes a can assembly 20 capable of storing contents, a spray cap 30 arranged on the can assembly 20 and capable of releasing the contents, and a cover assembly 10 buckled on the top of the can assembly 20 of the spray can 100 and shielding the spray cap 30. The cover assembly 10 includes an outer cover 1, a piston cover 2 capable of being mounted into the outer cover 1 in a push-pull mode, and an insert tube 4 fixedly arranged on the top of the outer cover 1 and communicating with an inner cavity of the outer cover 1. Wherein, the can assembly 20 includes a can body 201, a transfer cover 202, a valve cover 203 arranged on the top of the can body 201 through the transfer cover 202, and a valve body (belonging to a prior art, not shown) arranged in the can body 201 and connected with the valve cover 203. The contents described herein refer to main agents such as drugs or paint. In fact, propellants, for example, compressed nitrogen or carbon dioxide or the like, should be added into the can assembly 20. The piston cover 2 and the outer cover 1 are both made of metal or resin materials.

In the embodiment, the cover assembly 10 has a function of shielding the spray cap 30 of the spray can 100 and also has a function of pushing the contents into the can assembly 20. When the spray cap 30 of the spray can 100 needs to be shielded, the bottom end of the outer cover 1 is buckled on the top of the can assembly 20 of the spray can 100, and the piston cover 2 may fully enter the outer cover 1 and shield the spray cap 30 of the spray can 100, for details, seeing FIG. 1. When the contents need to be pushed into the can assembly 20 of the spray can 100, firstly, the contents need to be loaded into a place between the piston cover 2 and the outer cover 1, then the top end of the outer cover 1 is buckled on the top of the can assembly 20 of the spray can 100 and promotes the insert tube 4 to be capable of being inserted into the can assembly 20, and finally, the piston cover 2 is pushed to sequentially push the contents previously loaded into the place between the piston cover 2 and the outer cover 1 into the insert tube 4 and the can assembly 20 of the spray can 100, for details, seeing FIG. 2. By this means, a user may load the contents that selected on site or deployed on site into the can assembly 20 of the spray can 100 according to temporary requirements and realize paint spraying or drug spraying or the like through the spray can 100, which ensures that the cover assembly 10 is more functional and helps to improve user's satisfaction when using the spray can 100.

Figure 3:
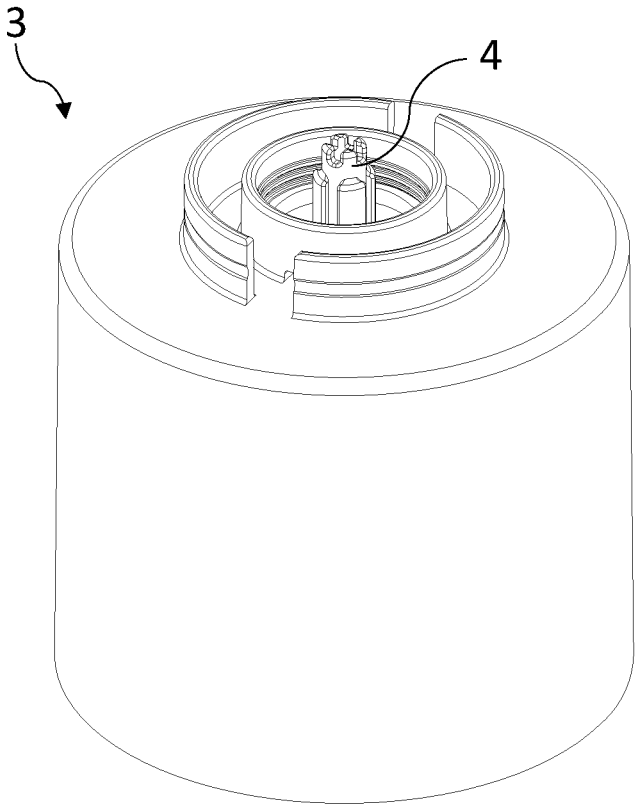
FIG. 3 shows a stereogram of an outer cover of the spray can as shown in FIG. 1.
Figure 4:
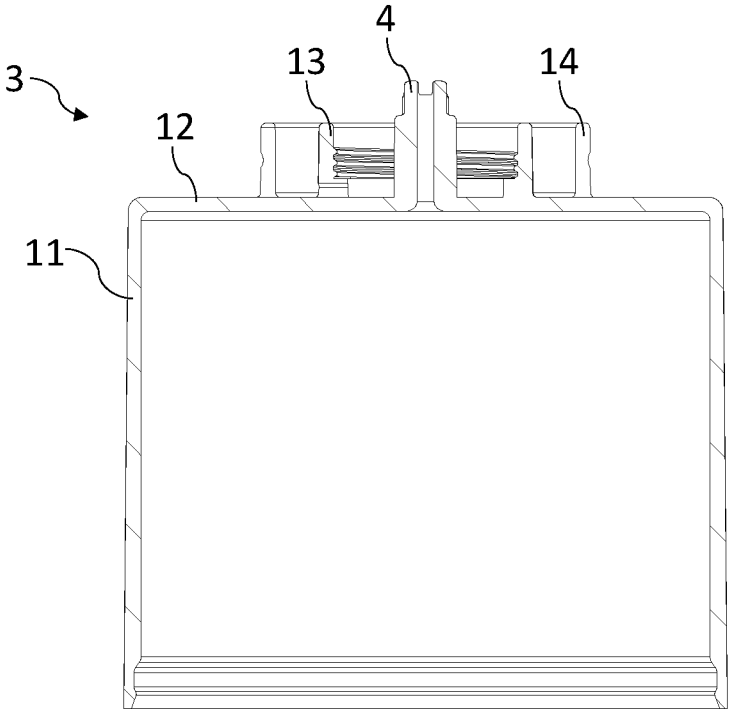
FIG. 4 shows a sectional view of the outer cover of the spray can as shown in FIG. 1.
Figure 5:
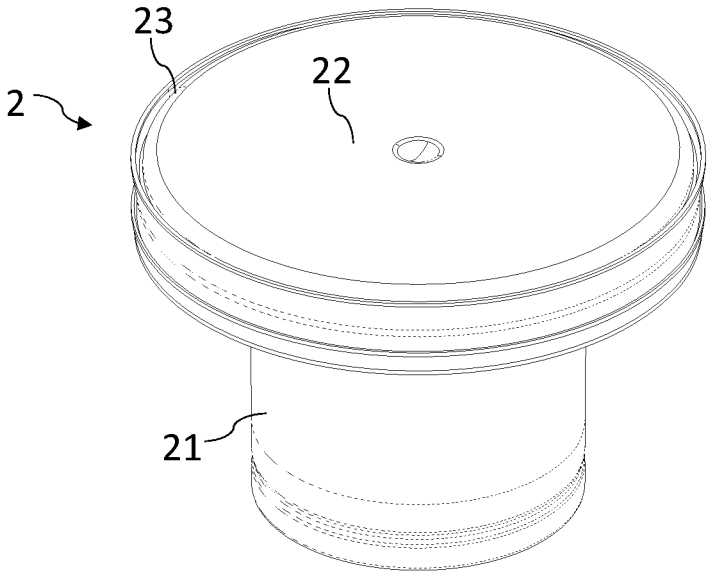
FIG. 5 shows a stereogram of a piston cover of the spray can as shown in FIG. 1.
Figure 6:
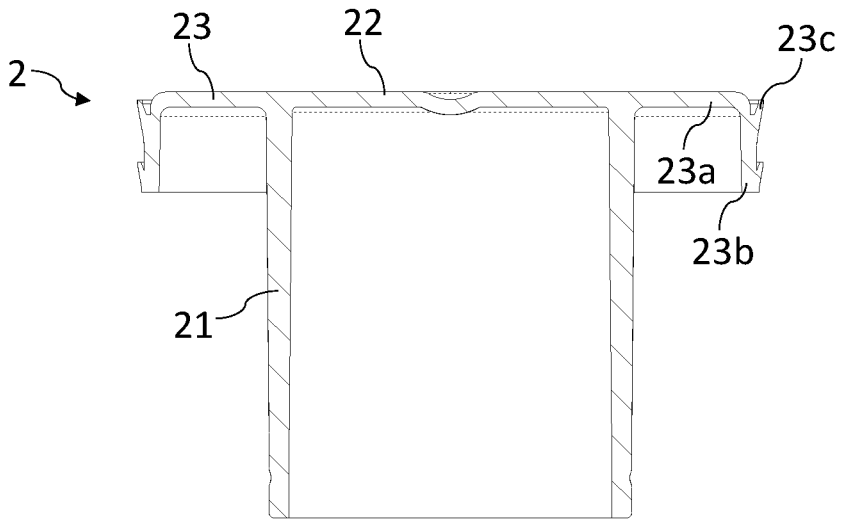
FIG. 6 shows a sectional view of the piston cover of the spray can as shown in FIG. 1.
Figure 7:
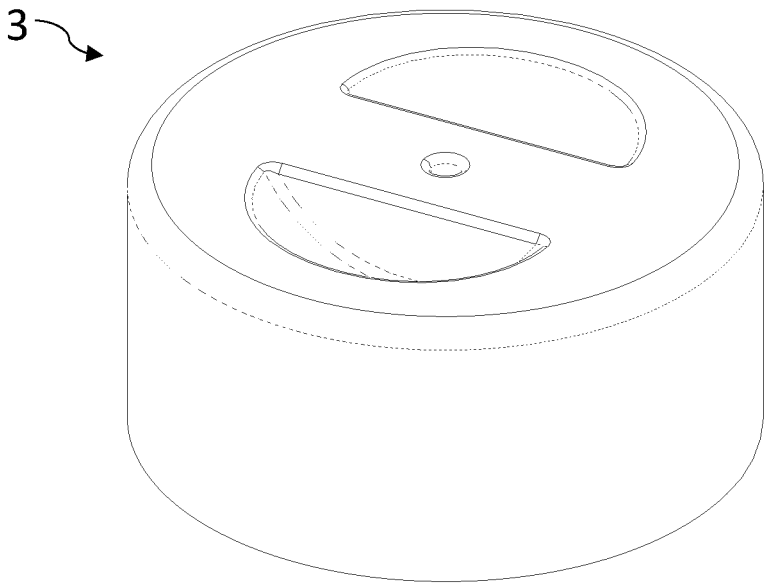
FIG. 7 shows a stereogram of a gland of the spray can as shown in FIG. 1.
Figure 8:
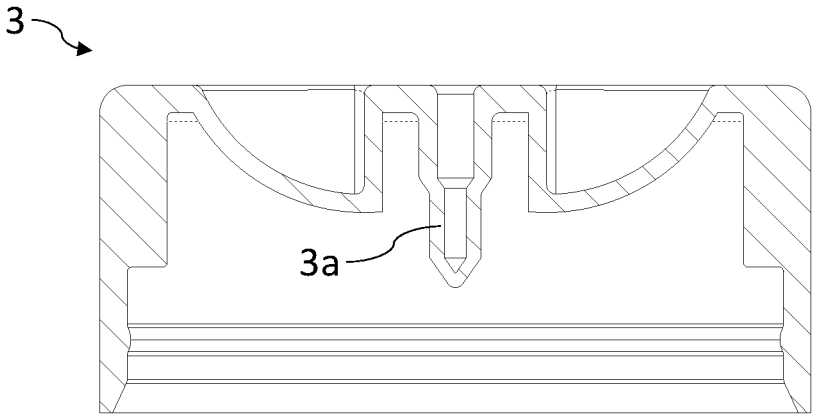
FIG. 8 shows a sectional view of the gland of the spray can as shown in FIG. 1.

In the embodiment, as shown in FIG. 3 and FIG. 4, the outer cover 1 includes an outer cover circumferential wall 11 and an outer cover top wall 12 connected with a top wall edge of the outer cover circumferential wall 11. The bottom of the outer cover circumferential wall 11 may sleeve an inwardly-curled structure **200*b* or outwardly-curled structures 200*a* (see FIG. 2) of the can assembly 20, wherein the inwardly-curled structure 200*b* is a connecting structure between the transfer cover 202 of the can assembly 20 and the valve cover 203 of the can assembly 20, and the outwardly-curled structures 200*a* are connecting structures between the transfer cover 202 and the can body 201 of the can assembly 20. When the bottom end of the outer cover 1 is buckled on the top of the can assembly 20 of the spray can 100, the bottom of the outer cover circumferential wall 11 may sleeve the inwardly-curled structure 200*b* or the outwardly-curled structures 200*a* of the can assembly 20, ensuring that the outer cover 1 may shield the piston cover 2 and the spray cap 30 therein. The outer cover top wall 12 is provided with a central through hole so that the insert tube 4 may be arranged on the top of the outer cover 1 and communicate with the inner cavity of the outer cover 1 through the central through hole, thereby ensuring that the insert tube 4 may release the contents from the can assembly 20** when required.

In the embodiment, the outer cover 1 further includes a first ring wall 13, a second ring wall 14 (see FIG. 3 and FIG. 4) and/or a third ring wall 15 (see FIG. 1 and FIG. 2). The first ring wall 13 is coaxially arranged on the top of the outer cover circumferential wall 11 and may be jointed with a peripheral face of a central convex part of the valve cover 203 in a matched mode. The second ring wall 14 is coaxially arranged on the top of the outer cover circumferential wall 11 and may be jointed with the inner edge of the inwardly-curled structure **200*b* of the can assembly 20 in a matched mode, and the third ring wall 15 is coaxially arranged on the top of the outer cover circumferential wall 11 and may be jointed with the outer edge of the inwardly-curled structure 200*b* of the can assembly 20 in a matched mode. When the top end of the outer cover 1 is buckled on the top of the can assembly 20 of the spray can 100 and promotes the insert tube 4 to be inserted into the can assembly 20, the first ring wall 13, the second ring wall 14 and the third ring wall 15 may strengthen the outer cover 1 and prevent the insert tube 4 from tilting or being pulled apart during inserting, and may even limit the inserting depth of the insert tube 4. After the insert tube 4 has been inserted into the can assembly 20, a certain degree of sealing may be realized between the first ring wall 13 and the can assembly 20, between the second ring wall 14 and the can assembly 20 as well as between the third ring wall 15 and the can assembly 20**.

Preferably, the joint mode between the first ring wall 13 and the central convex part of the valve cover 203 is threaded connection or clamping joint, which may not only improve the sealing effect here, but also prevent the outer cover 1 from being unintentionally separated from the can assembly 20.

In the embodiment, as shown in FIG. 1, FIG. 2, FIG. 5 and FIG. 6, the piston cover 2 includes a piston cover circumferential wall 21, a piston cover top wall 22 connected with the top edge of the piston cover circumferential wall 21, and a bent wall 23 fixedly sleeving the top of the piston cover circumferential wall 21 and bent towards the bottom of the piston cover circumferential wall 21. Wherein, the bent wall 23 may be jointed with the inner surface of the outer cover circumferential wall 11 in a sealed mode, and the bent wall 23 have greater elasticity than the piston cover circumferential wall 21. Thus, it may ensure that the sealing effect between the bent wall 23 and the outer cover 1 is better, thereby preventing the contents from overflowing from here when being injected into the can assembly 20. Preferably, the bent wall 23 includes a radial part 23*a* outwardly extending from the top edge of the piston cover circumferential wall 21 in the radial direction, a circumferential part 23*b* extending from the outer edge of the radial part 23*a* in the axial direction, and a cocked eave 23*c* arranged on the circumferential part 23*b* in a surrounding mode and capable of being jointed with the inner surface of the outer cover circumferential wall 11 in a sealed mode.

The additionally-arranged cocked eave 23*c* may further improve the sealing effect between the bent wall 23 and the outer cover 1. In order to ensure that the bent wall 23 has greater elasticity than the piston cover circumferential wall 21, the bent wall 23 is constructed slightly thinner than the piston cover top wall 22.

In the embodiment, as shown in FIG. 1, FIG. 2, FIG. 7 and FIG. 8, the spray can 100 may also include a gland 3. The gland 3 may be buckled on the top end of the outer cover 1, especially the first ring wall 13, the second ring wall 14 and/or the third ring wall 15 and block the insert tube 4, and may also be buckled on the bottom end of the piston cover 2 and block the bottom end of the piston cover 2. When being buckled on the first ring wall 13, the second ring wall 14 and/or the third ring wall 15, the gland 3 may prevent foreign matter from falling into the insert tube 4 and may also prevent the contents inside the insert tube 4 from accidentally flowing into the gland 3, for details, seeing FIG. 1. When the gland 3 is buckled on the bottom end of the piston cover 2 and blocks the bottom end of the piston cover 2, the user may push the piston cover 2 in the mode of pressing the gland 3 to avoid the user from feeling uncomfortable due to direct contact with the bottom edge of the piston cover 2, for details, seeing FIG. 2. Preferably, the joint mode between the gland 3 and the piston cover 2 is threaded connection or clamping joint to reduce separation of the gland 3 from the piston cover 2 in the case of unintentional operation. Similarly, the joint mode between the gland 3 and the outer cover 1 is also threaded connection or clamping joint to reduce separation of the gland 3 from the outer cover 1 in the case of unintentional operation. Preferably, the gland 3 may further include a plug 3*a* arranged on the inner wall of the top wall thereof, the plug 3*a* may be inserted into an inlet of the insert tube 4 and more safely prevent the contents inside the insert tube 4 from flowing into the gland 3.

In conclusion, the spray can 100 of the embodiment of the present disclosure uses the improved can assembly 10. The cover assembly 10 may push the contents into the can assembly 20 of the spray can 100 in addition to shielding the spray cap 30 of the spray can 100, and thus the user may load the temporarily-selected or temporarily-deployed contents into the can assembly 20 of the spray can 100 according to requirements and realize paint spraying or drug spraying or the like through the spray can 100, which ensures that the cover assembly is more functional and helps to improve user's satisfaction when using the spray can 100.

In the description of the present application, it should be understood that the orientations or positional relationships indicated by the terms such as "top" and "bottom" are based on those shown in FIG. 1, only to facilitate the description of the present disclosure and simplify the description, rather than indicating or implying that devices or elements that referred to must have specific orientations or be constructed and operated in the specific orientations. Thus, it may not be understood as the limitation on the present disclosure.

In the present application, unless otherwise expressly specified and qualified, terms such as "mounting", "joint", "connection" and "fixing" should be understood broadly, for example, it may refer to fixed connection, may also refer to detachable connection, or integrating; it may refer to mechanical connection, and may also refer to electrical connection; it may refer to direct joint, and may also refer to indirect joint through an intermediary; and it may refer to communication within two elements or the interactive relationship of the two elements. For those of ordinary skill in the art, the specific meanings of the above terms in the present disclosure may be understood according to specific circumstances.

What is said above is only the preferred implementation of the present disclosure, but the protection scope of the present disclosure is not limited to this, any of those skilled in the art may easily make changes or modifications in the technical scope disclosed by the present disclosure, and such changes or modifications should be covered by the protection scope of the present disclosure. Thus, the protection scope of the present disclosure should be subject to the protection scope of the claims. All technical features mentioned in each embodiment may be combined in any manner provided that there is no structural conflict. The present disclosure is not limited to specific embodiments disclosed herein, but includes all technical solutions falling within the scope of the claims.

The invention claimed is:

1. A cover assembly for a spray can, characterized by comprising:

an outer cover;

a piston cover, capable of being mounted into the outer cover in a push-pull mode;

an insert tube, fixedly arranged on a top of the outer cover and communicating with an inner cavity of the outer cover; and a gland;

wherein the gland is capable of being buckled on the top end of the outer cover and blocking the insert tube, and also being capable of being buckled on the bottom end of the piston cover and blocking a bottom end of the piston cover;

when a bottom end of the outer cover is buckled on a top of a can assembly of the spray can, the piston cover is capable of fully entering the outer cover and shielding a spray cap of the spray can; and when a top end of the outer cover is buckled on the top of the can assembly of the spray can, the insert tube is capable of being inserted into the can assembly so that the piston cover may sequentially push contents, previously loaded into a place between the piston cover and the outer cover into the insert tube and the can assembly of the spray can, after being pushed.

2. The cover assembly according to claim 1, characterized in that the outer cover comprises:

an outer cover circumferential wall, with a bottom being capable of sleeving an inwardly-curled structure or outwardly-curled structures of the can assembly of the spray can, wherein the inwardly-curled structure is a connecting structure between a transfer cover of the can assembly and a valve cover of the can assembly, and the outwardly-curled structures are connecting structures between the transfer cover and a can body of the can assembly;

an outer cover top wall, connected with a top wall edge of the outer cover circumferential wall and provided with a central through hole, the insert tube being arranged on the top of the outer cover in an inserting mode and communicating with the inner cavity of the outer cover through the central through hole.

3. The cover assembly according to claim 2, characterized in that the outer cover further comprises a first ring wall, a second ring wall and optionally a third ring wall, the first ring wall being coaxially arranged on a top of the outer cover circumferential wall and capable of being jointed with a peripheral face of a central convex part of the valve cover in a matched mode, the second ring wall being coaxially arranged on the top of the outer cover circumferential wall and capable of being jointed with an inner edge of the inwardly-curled structure of the can assembly in a matched mode, and the third ring wall being coaxially arranged on the top of the outer cover circumferential wall and capable of being jointed with an outer edge of the inwardly-curled structure of the can assembly in a matched mode.

4. The cover assembly according to claim 3, characterized in that a joint mode between the first ring wall and the central convex part of the valve cover is threaded connection or clamping joint.

5. The cover assembly according to claim 1, characterized in that the piston cover comprises a piston cover circumferential wall, a piston cover top wall connected with a top edge of the piston cover circumferential wall, and a bent wall fixedly sleeving a top of the piston cover circumferential wall and bent towards a bottom of the piston cover circumferential wall, the bent wall being capable of being jointed with an inner surface of and outer cover circumferential wall of the outer cover in a sealed mode, and the bent wall having greater elasticity than the piston cover circumferential wall.

6. The cover assembly according to claim 5, characterized in that the bent wall comprises a radial part outwardly extending from the top edge of the piston cover circumferential wall in a radial direction, a circumferential part extending from an outer edge of the radial part in an axial direction, and a cocked eave arranged on the circumferential part in a surrounding mode and capable of being jointed with the inner surface of the outer cover circumferential wall in a sealed mode.

7. The cover assembly according to claim 6, characterized in that the piston cover and the outer cover are both made of resin materials.

8. The cover assembly according to claim 1, characterized in that a joint mode between the gland and the piston cover is threaded connection or clamping joint, and connection between the gland and the outer cover is also the threaded connection or the clamping joint.

9. A spray can, characterized by comprising a can assembly, a spray cap and the cover assembly according to claim 1.

* * * * *